US009316009B2

(12) United States Patent
Gray et al.

(10) Patent No.: US 9,316,009 B2
(45) Date of Patent: Apr. 19, 2016

(54) METHOD AND APPARATUS TO FILL AND FIRE PROOF HOLES IN CONCRETE FLOORS OF COMMERCIAL BUILDINGS UTILIZING A PRECAST PLUG

(71) Applicants: Gerald R. Gray, Costa Mesa, CA (US); Robert W. Johnson, Costa Mesa, CA (US)

(72) Inventors: Gerald R. Gray, Costa Mesa, CA (US); Robert W. Johnson, Costa Mesa, CA (US)

( * ) Notice: Subject to any disclaimer, the term of this patent is extended or adjusted under 35 U.S.C. 154(b) by 0 days.

(21) Appl. No.: 14/584,988

(22) Filed: Dec. 29, 2014

(65) Prior Publication Data

US 2015/0113900 A1 Apr. 30, 2015

Related U.S. Application Data

(63) Continuation of application No. 13/854,795, filed on Apr. 1, 2013, now Pat. No. 8,959,863.

(60) Provisional application No. 61/650,179, filed on May 22, 2012.

(51) Int. Cl.
*E04G 23/02* (2006.01)

(52) U.S. Cl.
CPC ..... *E04G 23/0288* (2013.01); *E04G 23/0203* (2013.01); *E04G 23/0285* (2013.01)

(58) Field of Classification Search
CPC ..... E04G 23/0203; E04G 23/02; Y10T 29/49718; Y10T 29/49732
See application file for complete search history.

(56) References Cited

U.S. PATENT DOCUMENTS

| | | | | |
|---|---|---|---|---|
| 2,052,384 | A | 8/1936 | Conran | |
| 3,300,943 | A * | 1/1967 | Owens | 52/745.11 |
| 3,722,037 | A | 3/1973 | Jaeger | |
| 3,727,271 | A | 4/1973 | Znamirowski | |
| 3,811,175 | A | 5/1974 | Garner | |
| 3,889,436 | A | 6/1975 | Elliott | |
| 4,270,318 | A | 6/1981 | Carroll et al. | |
| 4,301,629 | A | 11/1981 | Farr | |
| D273,091 | S | 3/1984 | Kurosaki | |
| 4,674,255 | A | 6/1987 | Derome | |
| 4,713,129 | A | 12/1987 | Inhofe, Jr. et al. | |
| 4,754,590 | A | 7/1988 | Gordon | |
| 4,807,415 | A | 2/1989 | Oak | |
| 4,823,978 | A | 4/1989 | Pufpaff | |
| 5,103,615 | A | 4/1992 | Owens | |
| 5,327,942 | A | 7/1994 | Black | |
| 5,344,268 | A | 9/1994 | Fischer | |
| 5,499,737 | A | 3/1996 | Kraus | |
| 5,992,858 | A | 11/1999 | Teaster | |
| 6,797,354 | B2 | 9/2004 | Fleck | |

(Continued)

*Primary Examiner* — Rodney Mintz
*Assistant Examiner* — Daniel Kenny
(74) *Attorney, Agent, or Firm* — Jafari Law Group, Inc; David V. Jafari; Saul Acherman

(57) ABSTRACT

The present apparatus and method relates in general to sealing a hole in a floor with a precast plug. A precast plug is created by pouring a wet aggregate mix into a form mold and thereafter inserting a pre bent rod into the uncured mixture, positioning it such that the center of the rod rests in the center of the form mold and the ends of the rod extend outward near the top of the form mold. The mix is then cured. The precast plug may then be transported to the hole that it is destined to fix. Grooves may be carved on either side of the hole to accommodate the rod's ends. The interior of the hole and the exterior of the plug may then be covered with a sealant, after which the plug may be inserted into the hole. Once the sealant cures, the hole is fully repaired.

19 Claims, 5 Drawing Sheets

(56) References Cited

U.S. PATENT DOCUMENTS

| | | | | |
|---|---|---|---|---|
| 6,918,219 | B1 | 7/2005 | Olson | |
| D553,717 | S | 10/2007 | Nicholson | |
| 7,347,655 | B2 | 3/2008 | Nagasawa et al. | |
| 7,380,382 | B2 | 6/2008 | Hansen | |
| 7,455,192 | B2 | 11/2008 | Siragusa | |
| 7,581,361 | B1 | 9/2009 | Murkland | |
| D617,178 | S | 6/2010 | Sakai | |
| 7,797,892 | B2 | 9/2010 | Cannistraro | |
| 7,836,659 | B1 | 11/2010 | Barnes | |
| D632,550 | S | 2/2011 | Watanabe | |
| D638,103 | S | 5/2011 | Roll | |
| 7,984,595 | B2 | 7/2011 | Reen | |
| 8,256,988 | B1 | 9/2012 | Haber | |
| 2002/0102381 | A1 | 8/2002 | McClurg | |
| 2007/0113490 | A1 | 5/2007 | Boyd | |
| 2008/0028696 | A1 | 2/2008 | Fennell | |
| 2008/0196562 | A1* | 8/2008 | Elliston et al. | 81/433 |
| 2008/0314902 | A1 | 12/2008 | Dayton et al. | |
| 2009/0320391 | A1 | 12/2009 | Stubblefield et al. | |
| 2011/0023395 | A1 | 2/2011 | Hoshi | |
| 2011/0110743 | A1 | 5/2011 | Heimer | |
| 2012/0124796 | A1* | 5/2012 | Ibanez Ceba | 29/33 K |

* cited by examiner

METHOD AND APPARATUS TO FILL AND FIRE PROOF HOLES IN CONCRETE FLOORS OF COMMERCIAL BUILDINGS UTILIZING A PRECAST PLUG

The present application claims priority under 35 U.S.C. §119(e) and under 35 USC §120, to U.S. patent application with Ser. No. 13/854,795, filed on Apr. 1, 2013, which claims priority to U.S. Provisional Patent Application Ser. No. 61/650,179, filed on May 22, 2012, the disclosures of which are incorporated herein by reference in their entirety.

TECHNICAL FIELD OF THE INVENTION

The present apparatus and method relates in general to a plug that is used to repair and restore holes that a tenant drilled in the floor of the space that the tenant occupied during a tenancy.

COPYRIGHT & TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Typically, a condition in a lease contract between a commercial building owner and a tenant is that at the end of the lease the tenant must return the leased premises in the same condition that it was in at the time the tenant took possession, save for normal wear and tear. During the course of a tenancy, a lessee will typically cause numerous holes to be drilled into the concrete floor and/or ceiling of his suite to accommodate the routing of electrical wires, plumbing pipes, voice cables, and other such items that run through the floors. In the great majority of mid and high rise office buildings, these floors are constructed of a lightweight aggregate poured on a metal underlayment or pan. This flooring assembly provides a fire break between floors. When the tenant vacates the premises, the drilled holes during the tenancy are left wide open as a result of the removal of the wiring, plumbing, etc. that had been previously installed. This is potentially a breach of the fire control properties of the flooring assembly. These holes are typically three to four inches in diameter, but can range up to twelve inches or larger. Until recently, most property owners did not recognize this as a problem, and as a result did not require the vacating tenant to repair and restore these holes. More recently, it has been recognized, however, as an issue that must be remedied before a new tenant can take possession of the property.

There are several products on the market that can be used to restore the fire break properties of the flooring assembly. Most utilize a mechanical closure of the hole by installing an expandable metal plug or cap, and require that they be installed through the bottom of the hole. This solution often requires that access to the underside of the floor be granted by another tenant or the owner. Such access may be disruptive, cause security and liability issues, necessitate that the repair work be performed after normal working hours, and cause possible damage to another tenant's property. The parts and labor associated with these products tend to be rather expensive as well.

Another problem with other products is that the final repair results in a protruding floor surface. This is a design flaw that complicates future use of the floor where the protrusion is located.

Yet another problem related to repairing holes after a lease has expired is shoddy repair work. To honor the lease, a tenant may merely stuff a rag or other such material in the hole and then fill it with a plaster, such as FIX-IT-ALL™. Such a repair is insufficient, as there is nothing to keep the rag and plaster from falling through the floor into the suite below. Moreover, such a repair may be prone to water leaks and likely does not conform to the fire code, and testing these properties would be overly burdensome, defeating the purpose of the repair in the first place.

It is to these ends that the present apparatus and method has been developed.

BRIEF SUMMARY OF THE INVENTION

To minimize the limitations in the prior art, and to minimize other limitations that will be apparent upon reading and understanding the present specification, the present apparatus describes a precast plug for sealing a hole in a floor comprising a concrete housing and at least one rod whereby the distal end of said at least one rod makes at least one protrusion from at least one edge of said concrete housing.

The present method and apparatus also describes a method for repairing a hole in a floor, comprising the steps of preparing a wet cement mixture, pouring said wet cement mixture into a form mold housing, installing into said form mold housing at least one rod whereby the distal end of said at least one rod makes at least one protrusion from at least one edge of said concrete housing, allowing said mixture to cure with said at least one rod in place, thereby creating a precast plug, grinding at least one groove into said floor to house the distal end of said at least one rod, coating said precast plug's edges with a sealant, placing said precast plug into said hole such that the distal end of said at least one rod rests in said at least one groove, and allowing said sealant to cure.

It is an objective of the present apparatus and method to seal a hole in a floor such as to make it fire resistant, water resistant, and structurally sound.

Is another objective of the present apparatus and method to allow for ease of installation, making a repair job quick and efficient.

It is yet another objective of the present apparatus and method to repair a hole in a floor, such that the apparatus is flush with the floor's surface.

These and other advantages and features of the present apparatus and method are described herein with specificity so as to make the present apparatus and method understandable to one of ordinary skill in the art.

BRIEF DESCRIPTION OF THE SEVERAL VIEWS OF THE DRAWINGS

Elements in the FIGS. have not necessarily been drawn to scale in order to enhance their clarity and improve understanding of these various elements and embodiments of the apparatus and method. Furthermore, elements that are known to be common and well understood to those in the industry are not depicted in order to provide a clear view of the various embodiments of the apparatus and method.

DETAILED DESCRIPTION OF THE INVENTION

In the following discussion that addresses a number of embodiments and applications of the present apparatus and method, reference is made to the accompanying drawings that form a part thereof, where depictions are made, by way of illustration, of specific embodiments in which the apparatus and method may be practiced. It is to be understood that other embodiments may be utilized and changes may be made without departing from the scope of the apparatus and method.

Figure 1:
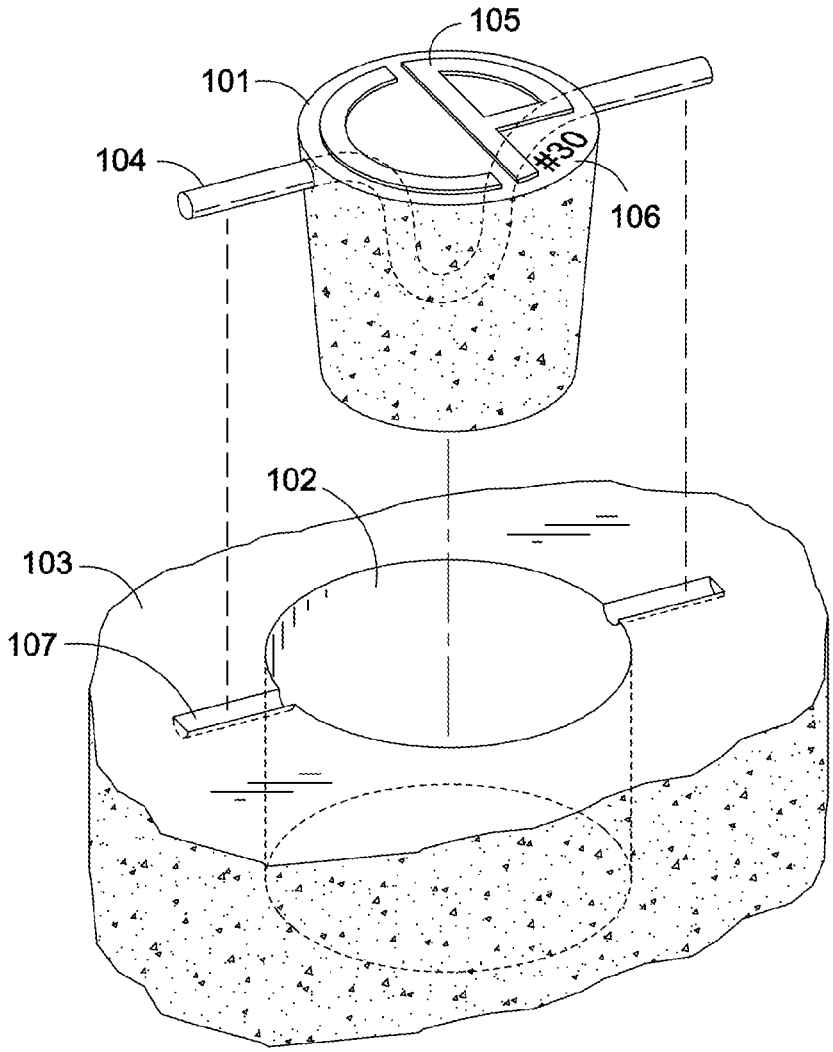
FIG. 1 is a three dimensional exploded cross-section view, depicting a precast plug housing one rod above a cutout section of a floor, before it is place in said floor.

FIG. 1 is a three dimensional exploded cross-section view, depicting precast plug 101 before it is placed in hole 102. This embodiment is a basic depiction of how precast plug 101 may function, namely to seal hole 102. It also depicts the various components of precast plug 101 including rod 104.

Precast plug 101 may be constructed off site, i.e., from where the hole it intends to repair is located. However, this is not to limit the scope of precast plug 101. If a particular location required precast plug 101 to be made on site, such as a remote location and time was of the essence, this could be accomplished by making precast plug 101 at the site of hole 102.

In either case, precast plug 101 may be constructed of the same material as floor 103, which in the typical scenario will be a lightweight aggregate or other cement, which has fire and water resistant properties in addition to structural integrity, similar to floor 103. For example, Rapid Set® Cement All™ may be used to construct precast plug 101, but this is not to limit the scope of the apparatus and method. In another embodiment, precast plug 101 may be constructed of plastic, steel, or any other material suitable for filling a cavity. Where a cement like material is used to prepare precast plug 101, it may be mixed with the requisite amount of water (and coloring if desired) to form a wet mixture. This mixture may then be poured into a form mold.

The shape and size of form mold, and therefore precast plug 101, may vary depending upon the type of repair job. The embodiment depicted in FIG. 1 shows precast plug 101 as having a cylindrical shaped housing with a slight inward taper from the top of precast plug 101 where logo 105 is located to the bottom of precast plug 101. However, a straight cylindrical form mold may also be employed to create precast plug 101 with no taper. Other embodiments of precast plug 101 may be cast in square, rectangular, triangular, and other variable sized and shaped form molds to create variable sized and shaped precast plugs 101. Precast plug's 101 diameter (or general width) is also variable depending upon the actual size of hole 102 to be repaired. A larger hole may necessitate a larger diameter form mold while a smaller hole may necessitate a smaller diameter form mold. Finally, the height of hole 102 is relevant to the size of the form mold to be used, which in the typical repair job may be three and one/half inches. The embodiment shown in FIG. 1 depicts precast plug 101 to be of substantially the same height as the height of hole 102, meaning from the top of floor 103 to the bottom of floor 103, however the actual height of precast plug 101 may vary.

Before the cement mixture cures in the properly sized form mold, an appropriately sized rod 104 may be inserted into the wet cement housing of precast plug 101. Rod 104 may be comprised of any number of materials, including steel, plastic, multiples of rods, etc., as will be further discussed below. As depicted in FIG. 1, rod 104 may be constructed of steel and may also be bent or molded such that it forms a "C" like shape in the center of rod 104. This allows for the "C" portion of rod 104 to be fully embedded within the form mold cement mixture, and the ends of rod 104 to extend from either side of what is soon to become precast plug 101 after curing. The ends, or "wings" of rod 104, may give precast plug 101 support when resting in hole 102 and prevent precast plug 101 from falling through the floor.

Precast plug 101 may also be embossed as depicted in FIG. 1 with logo 105 before cement mixture cures. However this is not to limit the scope of the apparatus and method. Logo 105 may also be a stamp, painting, etching, or any other mark to indicate who made precast plug 101. In FIG. 1, logo 105 consists of a capital "C" and a capital "P" indicating for example, a trademark. However, logo 105 may also consist of other combinations of letters, numbers, symbols, and/or pictures.

Precast plug 101 may also be stamped, as depicted in FIG. 1, with size indicator 106. Again, size indicator 106 may also be embossed, painted, etched, or generally engraved in such a way that it clearly communicates information about precast plug's 101 and/or hole's 102 dimensions. In FIG. 1, it may be noted that size indicator 106 is represented by a "#30". This may be a shorthand method of indicating that hole 102 is three inches for example. It could also be used to communicate that the width of precast plug 101 is three inches, if that would be a preferable method of measuring. However, other methods of communicating the size of precast plug 101 or the size of hole 102 may be employed such as a size indicator 106 depiction of "(3")" or "3 In.".

Logo 105 and size indicator 106 may also be used to communicate other desirable information, such as implied information. Implied information may be apprised from both logo 105 and size indicator 106 to indicate to appropriate authorities, such as a fire marshal, that the plug that is going to be installed or already has been installed into floor 103 is of such a quality and design that it meets appropriate fire codes and/or other safety regulations.

Further depicted in FIG. 1 are grooves 107 on either side of hole 102. Grooves 107 may not be preexisting. If not, grooves 107 may be ground out, for example, with an angle grinder, chiseled with a chisel, or carved out using some other device or mechanism to accommodate the "wings" of rod 104. Once the appropriate number of grooves 107 are carved out (and in the proper places), precast plug 101 may be inserted into hole 102 such that each "wing" of rod 104 may rest snugly within its own groove 107 and the top of precast plug 101 may rest flush with floor 103.

In another embodiment of the apparatus and method, rather than utilizing the technique of grooves 107, holes may be drilled in either side of the wall of hole 102, beneath the surface of floor 103. Similar tools may be employed as may be used to carve out grooves 107, including a right angle drill. Utilizing this technique, it would be possible not only to repair a hole in a floor below ones feet, but also a floor above one's head, i.e. a ceiling. In such a case, various embodiments of precast plug 101 may include logo 105 and size indicator 106 embossed or otherwise marked on the bottom side of precast plug 101, or rather on both ends of precast plug 101 to make it visible to one viewing precast plug 101 from above or below. The "wings" of rod 104 may also extend from a more central portion of precast plug 101 rather than being substantially flush with the top of precast plug 101. To accommodate the "wings" of rod 104 it may be necessary to drill deeper holes on either side of hole 102. After drilling the holes, one "wing" of rod 104 may be fully inserted into said drilled hole such that the side of precast plug 101 and interior of hole 102 are flush and the other "wing" of rod 104 is fully within hole 102 and extended in the direction of the drilled hole that it is to occupy. The entirety of precast plug 101 may then be laterally moved in that direction such that it is centered in hole 102 and both "wings" of rod 104 come to rest in either drilled hole.

Figure 2:
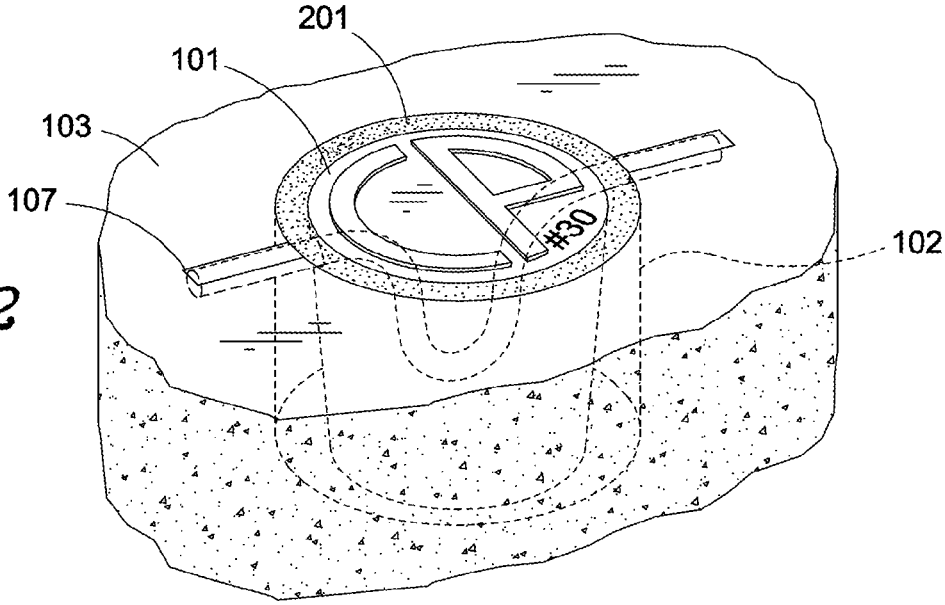
FIG. 2 is a three dimensional cross-section view of a precast plug that has been placed in a hole in a cutout section of a floor.

FIG. 2 is a three dimensional cross-section view of precast plug 101, that has been placed in hole 102 in a cutout section of floor 103. This embodiment is a basic depiction of how precast plug 101 functions, i.e. to seal hole 102 such that hole 102 is fire resistant, water resistant, and structurally sound. FIG. 2 also depicts how the top portion of precast plug 101 may not protrude from floor 103, but is relatively flush with floor 103. FIG. 2 further depicts how the bottom of precast plug 101 may be flush with the bottom side of floor 103.

Before appropriately sized precast plug 101 is fitted into hole 102, however, sealant 201 may be beaded around the exterior wall of precast plug 101 and the interior wall of hole 102, after which precast plug 101 may be fitted into hole 102. Once the "wings" of rod 104 are snugly within grooves 107, sealant 201 may be inserted into any voids such that hole 102 is completely full and/or excess sealant 201 may be wiped away from the area of hole 102. Sealant 201 may also be applied over the top of the "wings" of rod 104 to further secure rod 104 in place. After sealant 201 cures, what is left is a fire resistant, water resistant, and structurally sound repair job, which may be impliedly indicated by logo 105 as discussed above. As an example, 3M™ Fire Barrier Sealant IC 15WB+ may be used as sealant 201, however, this is not to limit the scope of the apparatus and method. Other products with similar properties may be employed in lieu of said brand.

Figure 3:
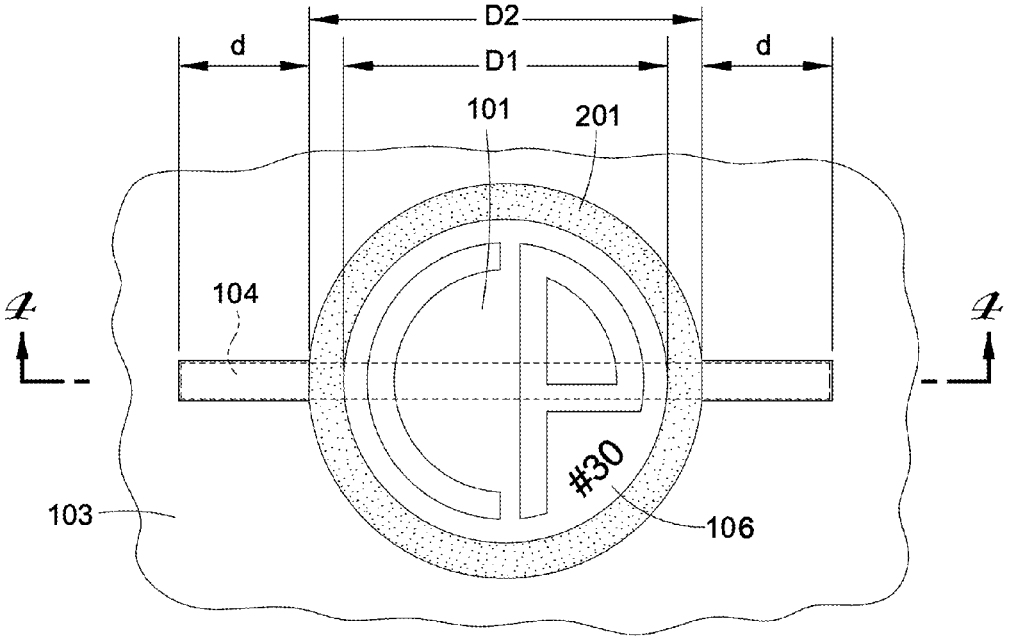
FIG. 3 depicts a plan cross section view with a precast plug fully installed into a hole.

FIG. 3 depicts a plan cross section view with precast plug 101 fully installed into hole 102 in a cutout section of floor 103. FIG. 3 also introduces another aspect of the present apparatus and method, videlicet, the various dimensions of the apparatus and method. Before installation of precast plug 101, it may be necessary to measure the size of hole 102 that is to be repaired. For example, size indicator 106 depicts a "#30", which may mean that before installation, it was measured that the size of hole 102 to be repaired was three inches. In such a case, whatever the width of hole 102 may be, D2 represents this dimension. D1 represents the width of precast plug 101. Finally, both d's represent the portion of how far rod 104 extends into floor 103. Depending upon the nature of the repair to be made, any and all of these dimensions may be lengthened or shortened to accommodate the repair.

FIG. 3 also depicts sealant 201 surrounding precast plug 101. Sealant 201, however, may also be applied over the top rod 104 to give further stability to the system and method.

Figure 4:
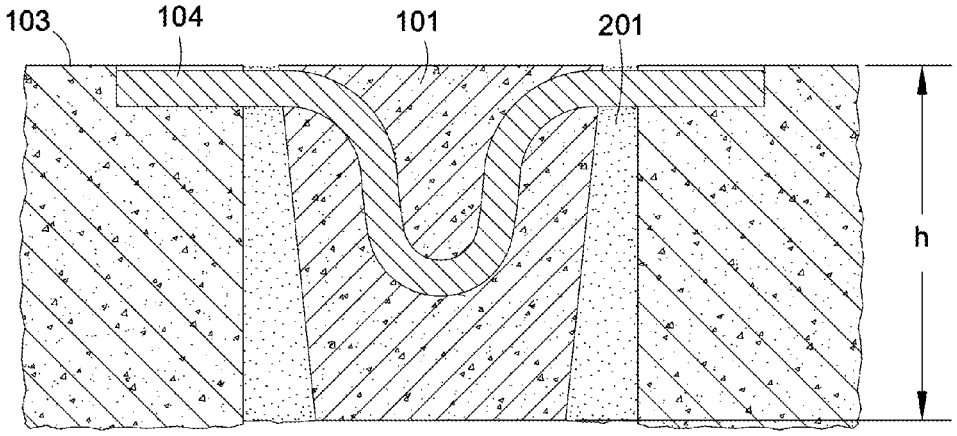
FIG. 4 depicts a front elevation cross section view of FIG. 3 with a precast plug fully installed into a hole.

FIG. 4 depicts a front elevation cross section view of FIG. 3 with precast plug 101 fully installed into hole 102 in a cutout section of floor 103. The location of the cross section is indicated in FIG. 3 by the 4-4 cross section line. As can be seen in this embodiment, rod 104 has a "C" shaped bend allowing for rod 104 to penetrate into the center of precast plug 101. This bend into the center of precast plug 101 allows for rod 104 to lend structural support to precast plug 101. Also seen from this view, the "wings" of rod 104 extend into floor 103 on either side of precast plug 101, where grooves 107 may have been chiseled to allow for proper installation of precast plug 101. This embodiment also depicts the slight inward taper of precast plug 101 at an unspecified degree. However, as mentioned above, this taper is not necessary, and in another embodiment, precast plug 101 may have an outward taper, which may make it easier to apply sealant 201. Another dimension depicted in FIG. 4 is the height h of floor 103. As mentioned above, precast plug 101 may be adapted to accommodate the varying heights of concrete floors in different buildings.

FIG. 4 also depicts sealant 201 as extending from the bottom edge of floor 103 to the top edge of floor 103 and fully encompassing the space between floor 103 and precast plug 101. In another embodiment, less sealant 201 may be applied such that enough is applied to fulfill its purpose, which is to seal hole 102.

Figure 5:
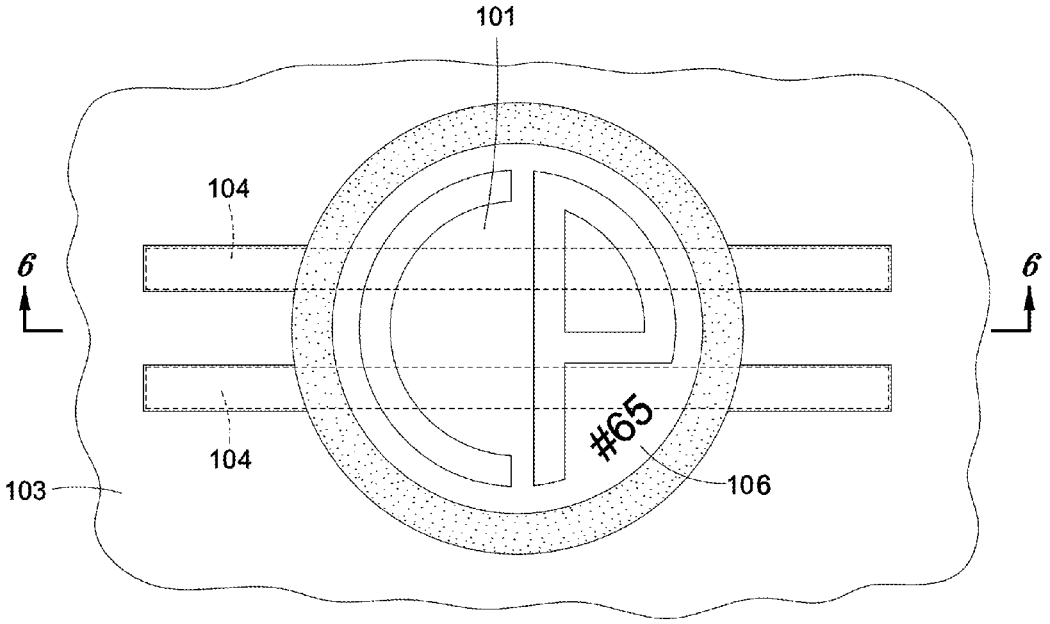
FIG. 5 is a plan cross section view of a precast plug in a floor depicting an alternative embodiment comprising two rods housed within a precast plug.

FIG. 5 is a plan cross section view depicting an alternative embodiment comprising two rods 104 housed within precast plug 101 rather than one as in previous figures. Two rods 104 may be suitable to lend further support for a larger precast plug 101 to repair a wider diameter hole 102 or a floor 103 of an increased height. FIG. 5 depicts a different sized precast plug 101 as indicated by size indicator 106. As discussed above, size indicator may refer to the size of precast plug 101 or the size of hole 102. For example the "#65" in FIG. 5 may indicate that hole 102 has a diameter of six point five inches.

Figure 6:
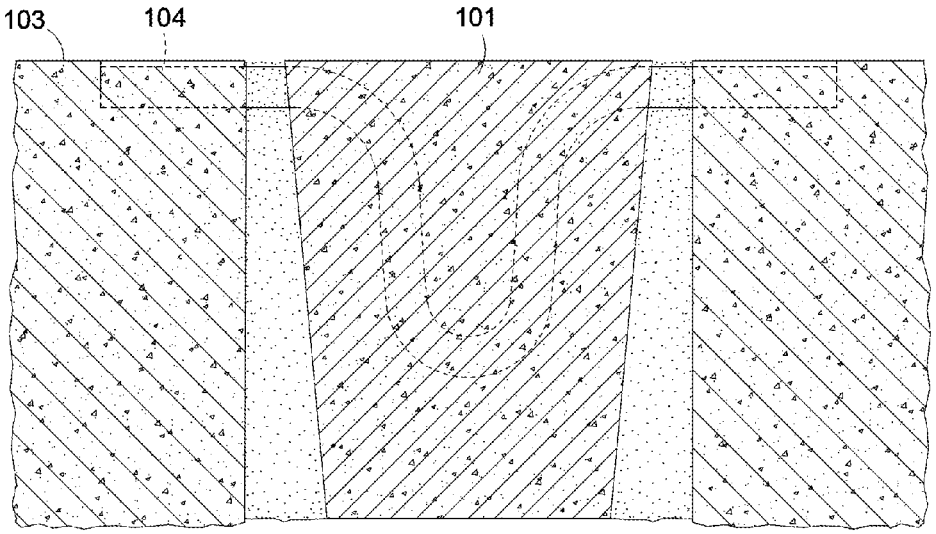
FIG. 6 depicts a front elevation cross section view of FIG. 5 with a precast plug fully installed into a hole.

The front elevation cross section view in FIG. 6 of FIG. 5 depicts a similar view as in FIG. 4. The location of the cross section is indicated in FIG. 5 by the 6-6 cross section line. This embodiment generally depicts, however, how rod 104 may be lengthened in order to accommodate a larger precast plug 101 that may be situated in a deeper hole 102 as may be the case with floor 103 of a greater height, such that rod 104 may still penetrate the center of precast plug 104 and lend its full support.

Figure 7:
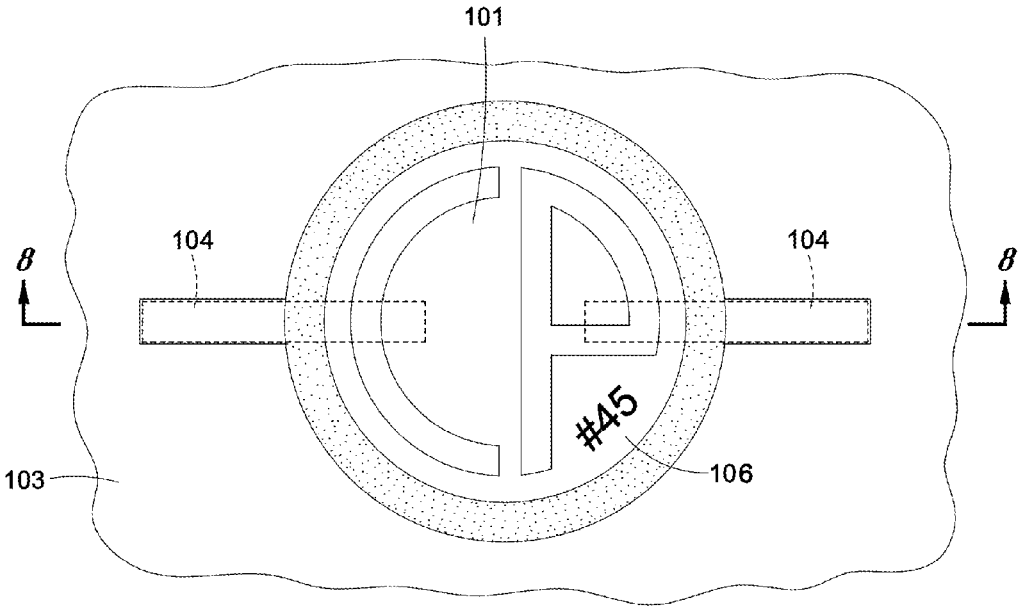
FIG. 7 is a plan cross section view depicting a further alternative embodiment utilizing two rods.

FIG. 7 is a plan cross section view of another embodiment of the apparatus and method utilizing two rods. However, as shown and as clarified further by the 8-8 cross section line in FIG. 8, the two separate rods 104 act as their own "wings" and are not part of a single rod 104. These separate rods 104 may be inserted into precast plug 101 in a similar fashion as described above, i.e., before the wet cement mixture fully cures within the form mold and such that the "wings" are substantially flush with the top of precast plug 101. In another embodiment, rods 104 may be positioned such that the "wings" of said rod extend from a central or lower position on either side of precast plug 101, rather than being flush with the top of precast plug 101. Utilizing one of these embodiments, precast plug 101 may be inserted into a ceiling as described above.

FIG. 7 further depicts another potential embodiment as represented by size indicator 106, which shows a "#45". This may represent that either hole 102 or precast plug 101 has a width of four and one/half inches.

Figure 8:
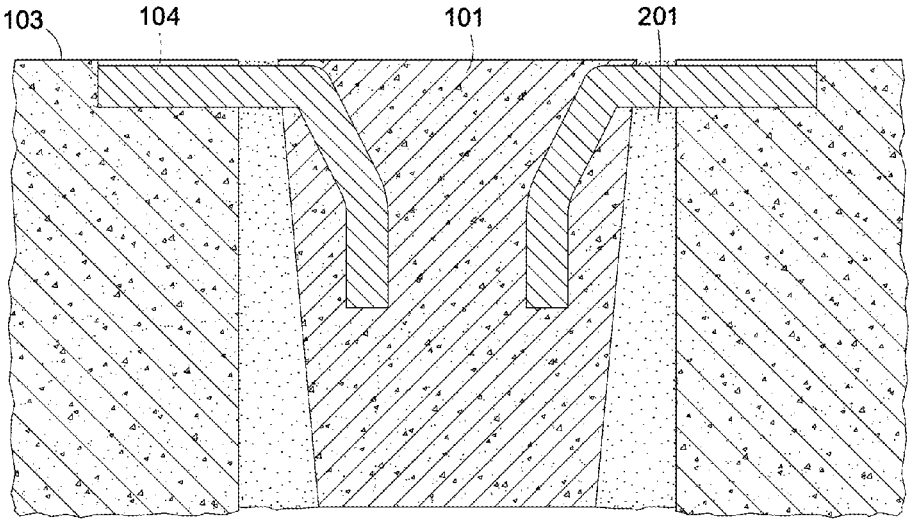
FIG. 8 depicts a front elevation cross section view of FIG. 7.

However, the embodiments depicted in FIGS. 7 and 8 are not to be construed as limiting the scope of the present apparatus and method. For example, rods 104 in FIG. 7 need not be within substantially the same plane as one another, but may be cured into precast plug 101 in a staggered fashion such that they are rather substantially parallel to one another. In another embodiment, four separate rods 104 similar to those used in FIGS. 7 and 8 may be cured into a single precast plug 101 and arranged in a fashion such that there are two pairs of rods 104 (see FIG. 7 for an example of an arrangement of one pair of rods) with each pair on substantially the same plane when viewed from above and the first pair being substantially parallel with the second pair.

In yet another embodiment, four separate rods 104 similar to the rods 104 depicted in FIGS. 7 and 8 may be cured into precast plug 101 such that each "wing" when viewed from above would point in a different direction, such as twelve o'clock, six o'clock, three o'clock and nine o'clock substantially bisecting precast plug 101 both vertically and horizontally. With such an embodiment, the method of installation may be modified to account for the requisite number of grooves 107 to house such "wings".

Figure 9:
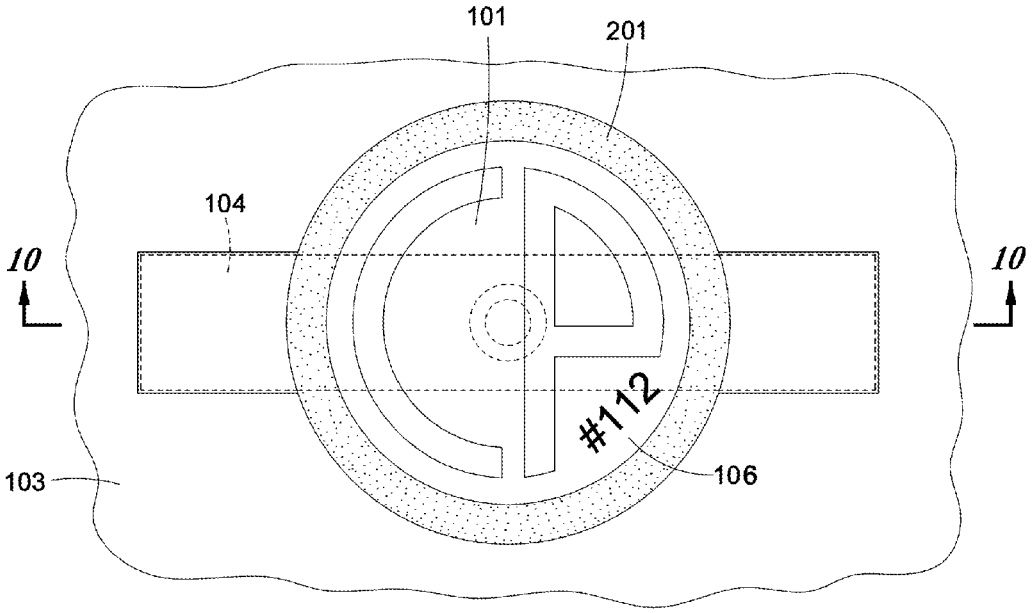
FIG. 9 is a plan cross section view depicting an alternative embodiment of the system and method whereby a rectangular like rod is housed within a precast plug.

FIG. 9 is a plan cross section view depicting an alternative embodiment of the apparatus and method. Rather than a tubular shape as discussed above, rod 104 may take on a substantially rectangular shape. In this embodiment, rod 104 may be comprised of a plastic "T" bar with a break away joint at the "T" intersection, as can be seen in the 10-10 cross section line in FIG. 10. The break away joint and base of the "T" of rod 104 may be a cylindrical arrow-like shape. Such an embodiment allows for this breakaway joint and base to grip the housing of precast plug 101, providing additional support so that precast plug 101 does not fall through hole 102. Rod 104 in plastic form, is not to limit the scope of the present apparatus and method. Other embodiments may include iron, wood, silicone, or other durable composite materials. Also, as mentioned above sealant 201 may be applied between precast plug 101 and floor 103, and over the top of rod 104 in the embodiment depicted in FIG. 9.

Figure 10:
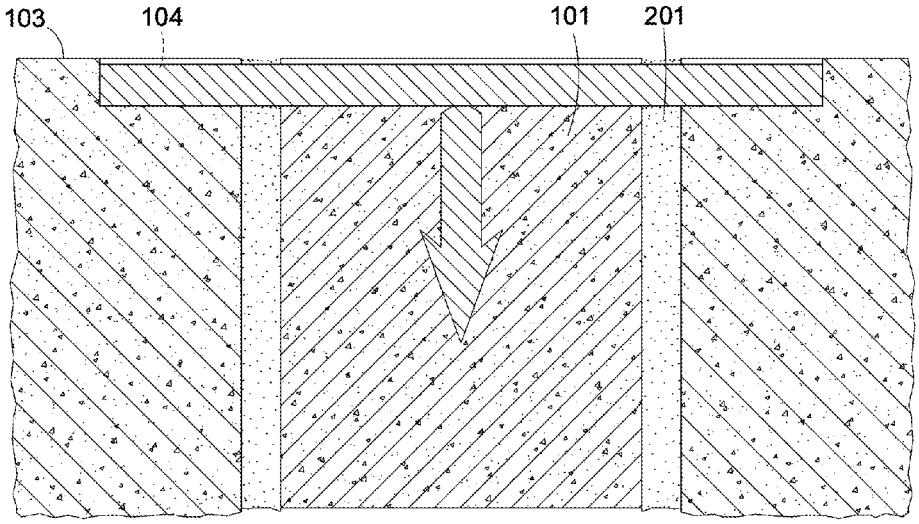
FIG. 10 depicts a front elevation cross section view of FIG. 9.

Finally, in FIG. 9, size indicator 106 depicts a "#112". This may indicate that either hole 102 or precast plug 101 may be eleven point two inches wide for example. FIG. 10 also depicts precast plug 101 with no tapered edge, an alternative embodiment to the present apparatus and method. An even column of sealant 201 fills the space between floor 103 and precast plug 101. In another embodiment, however, more or less sealant may be applied, e.g., if precast plug 101 were to taper outward or inward, or hole 102 were to taper inward or outward. In yet another embodiment sealant 201 may be applied such that it covers the bottom edge of precast plug 101 and/or the top edge of precast plug 101, such as to give further protection to precast plug 101 and floor 103.

What is claimed is:

1. An apparatus for sealing a hole in a floor comprising:

a concrete housing; and a plurality of rods, each rod partially situated immediately below a top planar surface of the concrete housing including a middle portion and distal ends, the middle portion of each rod embedded within the concrete housing, the distal ends of each rod situated external to the concrete housing and substantially flush with the top planar surface, wherein the plurality of rods are parallel to each other and configured to register with grooves adjacent to the hole.

2. The apparatus of claim 1, wherein the middle portion of each rod is bent to form a c-shape between the distal ends of each rod, the c-shape entirely embedded within the concrete housing.

3. The apparatus of claim 1, wherein the concrete housing includes the top planar surface, an outer wall, and a bottom planar surface that are integral to and unitarily form the concrete housing.

4. The apparatus of claim 3, wherein, the top planar surface of the concrete housing is parallel to the bottom planar surface of the concrete housing.

5. The apparatus of claim 1, wherein the concrete housing is cylindrically shaped and tapers inward.

6. The apparatus of claim 1, wherein at least one rod is comprised of steel.

7. The apparatus of claim 1, wherein at least one rod is comprised of plastic.

8. The apparatus of claim 1, wherein at least one rod is comprised of wood.

9. The apparatus of claim 1, wherein at least one rod is comprised of composite materials.

10. The apparatus of claim 1, further comprising a logo and a size indicator embossed on the concrete housing.

11. The apparatus of claim 1, further comprising a logo and a size indicator stamped on the concrete housing.

12. An apparatus for sealing a hole in a floor comprising:

a concrete housing including a top planar surface, an outer wall, and a bottom planar surface that are integral to and unitarily form the concrete housing, wherein the top planar surface of the concrete housing is parallel to the bottom planar surface of the concrete housing; and a plurality of rods, each rod including a middle portion and distal ends, the middle portion of each rod bent to form a c-shape between the distal ends of each rod, the c-shape entirely embedded within the concrete housing, and the distal ends of each rod situated external to the concrete housing, wherein the plurality of rods are parallel to each other and configured to register with grooves adjacent to the hole.

13. The apparatus of claim 12, wherein the distal ends of each rod situated external to the concrete housing are substantially flush with the top planar surface of the concrete housing.

14. The apparatus of claim 12, wherein the concrete housing is cylindrically shaped and tapers inward.

15. The apparatus of claim 12, wherein at least one rod is comprised of steel.

16. The apparatus of claim 12, wherein at least one rod is comprised of plastic.

17. The apparatus of claim 12, wherein at least one rod is comprised of wood.

18. The apparatus of claim 12, wherein at least one rod is comprised of composite materials.

19. An apparatus for sealing a hole in a floor comprising:

a cylindrical concrete housing including a top planar surface, an outer wall, and a bottom planar surface that are integral to and unitarily form the concrete housing, wherein the top planar surface of the concrete housing is parallel to the bottom planar surface of the concrete housing; and a plurality of steel rods, each rod including a middle portion and distal ends, the middle portion of each rod bent to form a c-shape between the distal ends of each rod, the c-shape entirely embedded within the concrete housing, the distal ends of each rod situated external to the concrete housing and substantially flush with the top planar surface of the concrete housing, wherein the plurality of rods are parallel to each other and configured to register with grooves adjacent to the hole.

* * * * *